US009267512B2

(12) United States Patent
Chrabascz et al.

(10) Patent No.: US 9,267,512 B2
(45) Date of Patent: Feb. 23, 2016

(54) RAM AIR FAN DIFFUSER WITH PERFORATED SIDE WALLS

(75) Inventors: Eric Chrabascz, Longmeadow, MA (US); Victoria S. Richardson, Hartford, CT (US); David A. Dorman, Feeding Hills, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1157 days.

(21) Appl. No.: 13/279,523

(22) Filed: Oct. 24, 2011

(65) Prior Publication Data

US 2013/0097997 A1 Apr. 25, 2013

(51) Int. Cl.
*F04D 29/54* (2006.01)

(52) U.S. Cl.
CPC ..... *F04D 29/541* (2013.01); *F04D 29/545* (2013.01); *Y10T 29/49323* (2015.01)

(58) Field of Classification Search
CPC ... F04D 29/541; F04D 29/545; F04D 29/542; F04D 29/547; F04D 19/00; F04D 29/584; F04D 29/664; F04D 29/54; F02K 1/82; Y10T 29/49323
USPC ..... 60/751
See application file for complete search history.

(56) References Cited

U.S. PATENT DOCUMENTS

| | | | | |
|---|---|---|---|---|
| 1,940,466 | A | | 12/1933 | Sneed |
| 2,527,229 | A | | 10/1950 | Roubal |
| 2,752,515 | A | | 6/1956 | Baudry et al. |
| 3,410,029 | A | | 11/1968 | Savage |
| 3,433,020 | A | | 3/1969 | Earle, Jr. et al. |
| 3,588,044 | A | | 6/1971 | Reichrath et al. |
| 3,763,835 | A | | 10/1973 | Miller et al. |
| 3,915,024 | A | | 10/1975 | Mort |
| 3,949,550 | A | | 4/1976 | Albrecht et al. |
| 3,999,872 | A | | 12/1976 | Allison |
| 4,012,154 | A | | 3/1977 | Durwin et al. |
| 4,213,736 | A | * | 7/1980 | Gongwer ..... 415/222 |
| 4,295,666 | A | * | 10/1981 | Melanson ..... 285/14 |
| 4,439,106 | A | | 3/1984 | Ferris et al. |
| 4,511,193 | A | | 4/1985 | Geczy |
| 4,543,785 | A | | 10/1985 | Patrick |
| 4,692,091 | A | * | 9/1987 | Ritenour ..... F04D 29/661 415/119 |
| 4,750,860 | A | * | 6/1988 | Kelley ..... 415/119 |
| 4,979,872 | A | | 12/1990 | Myers et al. |
| 5,239,815 | A | | 8/1993 | Barcza |
| 5,505,587 | A | | 4/1996 | Ghetzler |

(Continued)

OTHER PUBLICATIONS

Colson et al., U.S. Appl. No. 13/279,588, filed Oct. 24, 2011.

(Continued)

*Primary Examiner* — Phutthiwat Wongwian
*Assistant Examiner* — Carlos A Rivera
(74) *Attorney, Agent, or Firm* — Kinney & Lange, P.A.

(57) ABSTRACT

A diffuser for a ram air fan assembly includes a perforated cone, an inlet ring seal, and an outlet ring seal. The perforated cone has a frustoconical shape symmetrical about an axis of the diffuser. The inlet ring seal is attached to, and axially disposed about, a first end of the perforated cone. The inlet ring seal includes a fan housing connection having a cylindrical shape. The outlet ring seal is attached to, and axially disposed about, a second end of the perforated cone. An average external diameter of the second end is greater than an average external diameter of the first end such that the perforated cone extends away from the inlet ring seal and radially outward from the axis of the diffuser.

19 Claims, 6 Drawing Sheets

(56) References Cited

U.S. PATENT DOCUMENTS

| | | | | |
|---|---|---|---|---|
| 5,529,316 | A | 6/1996 | Mattila | |
| 5,683,184 | A | 11/1997 | Striedacher et al. | |
| 6,299,077 | B1 | 10/2001 | Harmon et al. | |
| 6,380,647 | B2 | 4/2002 | Hayashi et al. | |
| 6,698,933 | B2 | 3/2004 | Lau | |
| 6,926,490 | B2 | 8/2005 | McAuliffe et al. | |
| 6,928,963 | B2 | 8/2005 | Karanik | |
| 6,966,174 | B2 | 11/2005 | Paul | |
| 7,073,545 | B2 * | 7/2006 | Smith et al. | 141/285 |
| 7,165,939 | B2 | 1/2007 | Chen et al. | |
| 7,342,332 | B2 | 3/2008 | McAuliffe et al. | |
| 7,394,175 | B2 * | 7/2008 | McAuliffe et al. | 310/58 |
| 7,397,145 | B2 | 7/2008 | Struve et al. | |
| 7,757,502 | B2 | 7/2010 | Merritt et al. | |
| 7,952,241 | B2 | 5/2011 | Kato et al. | |
| 2002/0171218 | A1 | 11/2002 | Bell | |
| 2006/0061221 | A1 | 3/2006 | McAuliffe et al. | |
| 2010/0055383 | A1 | 3/2010 | Schalla et al. | |
| 2011/0005234 | A1 * | 1/2011 | Hashimoto et al. | 60/796 |
| 2012/0014784 | A1 * | 1/2012 | Hipsky et al. | 415/177 |

OTHER PUBLICATIONS

Colson et al., U.S. Appl. No. 13/279,529, filed Oct. 24, 2011.
Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/279,497, filed Oct. 24, 2011.
Binek et al., U.S. Appl. No. 13/279,508, filed Oct. 24, 2011.
Chrabascz et al., U.S. Appl. No. 13/279,534, filed Oct. 24, 2011.
Rosen et al., U.S. Appl. No. 13/279,576, filed Oct. 24, 2011.

* cited by examiner

RAM AIR FAN DIFFUSER WITH PERFORATED SIDE WALLS

BACKGROUND

The present invention relates to an environmental control system. In particular, the invention relates to a diffuser of a ram air fan assembly for an environmental control system for an aircraft.

An environmental control system (ECS) aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components, such as a diffuser, designed to improve the operational efficiency of the ram air fan, reduce its weight, or reduce noise generated by the aircraft.

SUMMARY

The present invention is a diffuser for a ram air fan assembly. The diffuser includes a perforated cone, an inlet ring seal, and an outlet ring seal. The perforated cone has a frustoconical shape symmetrical about an axis of the diffuser. The inlet ring seal is attached to, and axially disposed about, a first end of the perforated cone. The inlet ring seal includes a fan housing connection having a cylindrical shape. The outlet ring seal is attached to, and axially disposed about, a second end of the perforated cone. An average external diameter of the second end is greater than an average external diameter of the first end such that the perforated cone extends away from the inlet ring seal and radially outward from the axis of the diffuser.

DETAILED DESCRIPTION

The present invention is a diffuser for a ram air fan that helps direct a flow of air from a ram air fan rotor in such a way as to diffuse the fan air flow, enhance flow efficiency, and reduce ram air fan noise.

Figure 1:
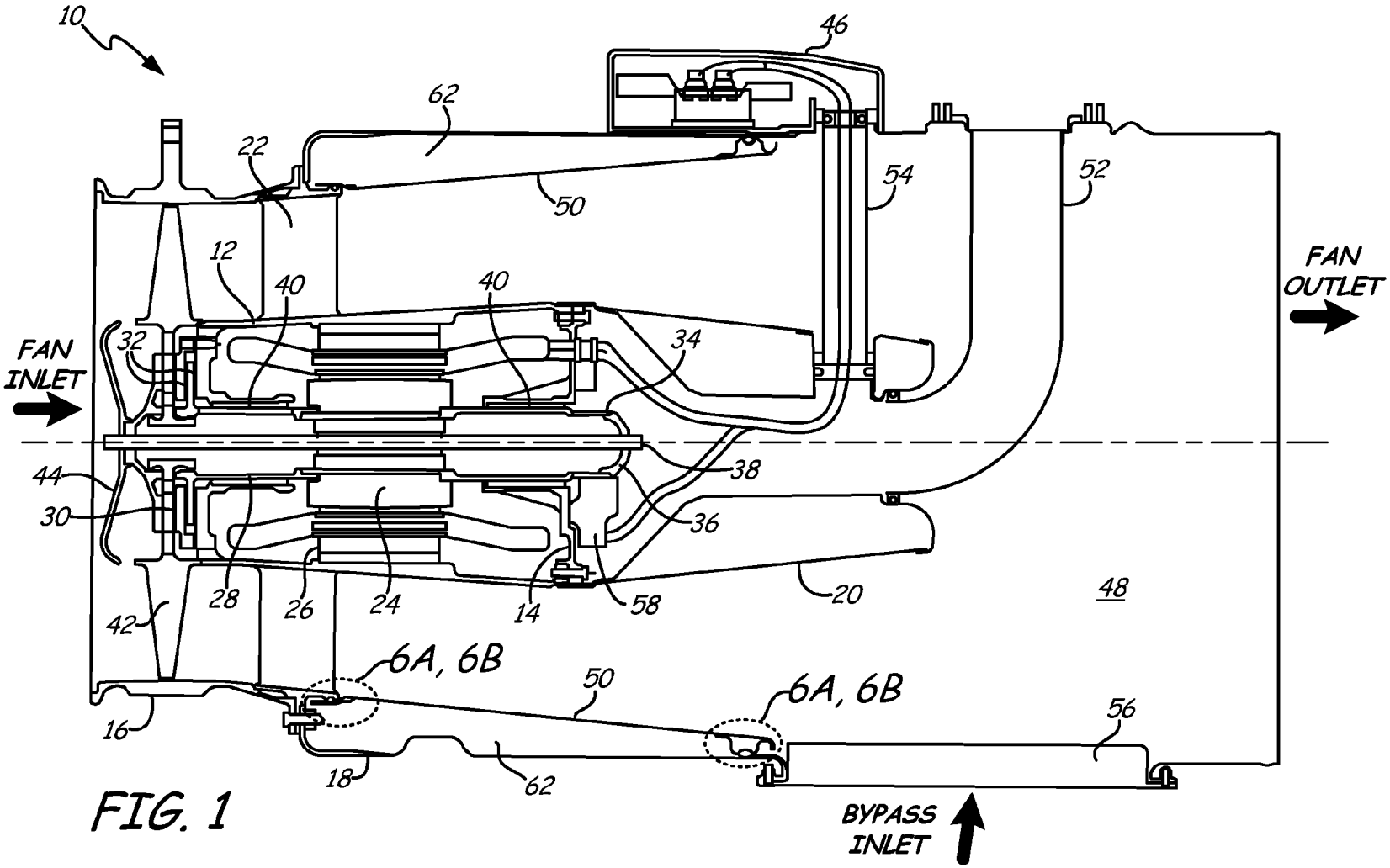
FIG. 1 is a side view of a ram air fan assembly incorporating the present invention.

FIG. 1 illustrates a ram air fan air assembly incorporating the present invention. FIG. 1 shows ram air fan assembly 10 including fan housing 12, bearing housing 14, inlet housing 16, outer housing 18, and inner housing 20. Fan housing 12 includes fan struts 22, motor rotor 24, motor stator 26, thrust shaft 28, thrust plate 30, and thrust plate 32. Bearing housing 14 includes journal bearing shaft 34 and shaft cap 36. Fan housing 12 and bearing housing 14 together include tie rod 38 and journal bearings 40. Inlet housing 16 contains fan rotor 42 and inlet shroud 44, in addition to a portion of tie rod 38. Outer housing 18 includes terminal box 46 and plenum 48. Within outer housing 18 are diffuser 50, motor bearing cooling tube 52, wire transfer tube 54, check valve 56, speed sensor 58, and acoustic foam 62. A fan inlet is a source of air to be moved by ram air fan assembly 10 in the absence of sufficient ram air pressure. A bypass inlet is a source of air from a ram air inlet (not shown) that flows through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 and inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 24 is contained within motor stator 26 and connects journal bearing shaft 34 to thrust shaft 28. Journal bearing shaft 34, motor rotor 24, and thrust shaft 28 define an axis of rotation for ram air fan assembly 10. Fan rotor 42 is attached to thrust shaft 28 with tie rod 38 extending along the axis of rotation from shaft cap 36 at the end of journal bearing shaft 34 through motor rotor 24, thrust shaft 38, and fan rotor 42 to inlet shroud 44. Nuts (not shown) secure shaft cap 36 to journal bearing shaft 34 on one end of tie rod 38 and inlet shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Inlet shroud 44, fan rotor 42, and a portion of fan housing 12 are contained within inlet housing 16. Diffuser 50 is attached to an inner surface of outer housing 18. Acoustic foam 62 fills at least most of the volume between diffuser 50 and outer housing 18. Speed sensor 58 is attached to bearing housing 14. Plenum 48 is a portion of outer housing 18 that connects ram air fan assembly 10 to check valve 56 and the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14. Energizing motor stator 26 causes rotor 24 to rotate about the axis of rotation for ram air fan assembly 10, rotating connected journal bearing shaft 34 and thrust shaft 28. Speed sensor 58 measures the rate of rotation of journal bearing shaft 34. Fan rotor 42 and inlet shroud 44 also rotate by way of their connection to thrust shaft 28. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, the air flows past diffuser 50 and inner housing 20, where the air pressure is reduced due to the shape of diffuser 50 and the shape of inner housing 20. Once past inner housing 20, the air moves out of outer housing 18 at the fan outlet. Check valve 56 remains closed to prevent air moving out of outer housing 18 and into the bypass inlet. Components within bearing housing 14 and fan housing 12, especially thrust bearings 32, journal bearings 40, motor stator 26, and motor rotor 24; generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling the components. Once the aircraft moves fast enough to generate sufficient ram air pressure to meet the cooling needs of the ECS, check valve 56 opens, and ram air is directed into plenum 48 from the bypass inlet. The ram air passes into outer housing 18 at plenum 48 and moves out of outer housing 18 at the fan outlet.

Figure 2A:
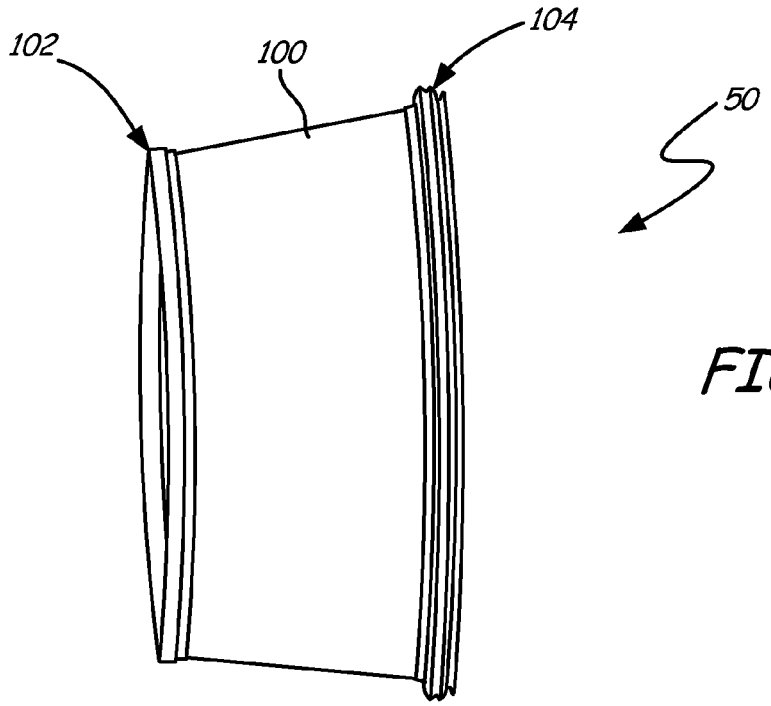
FIGS. 2A and 2B are perspective views of an embodiment of a diffuser incorporating the present invention.
Figure 2B:
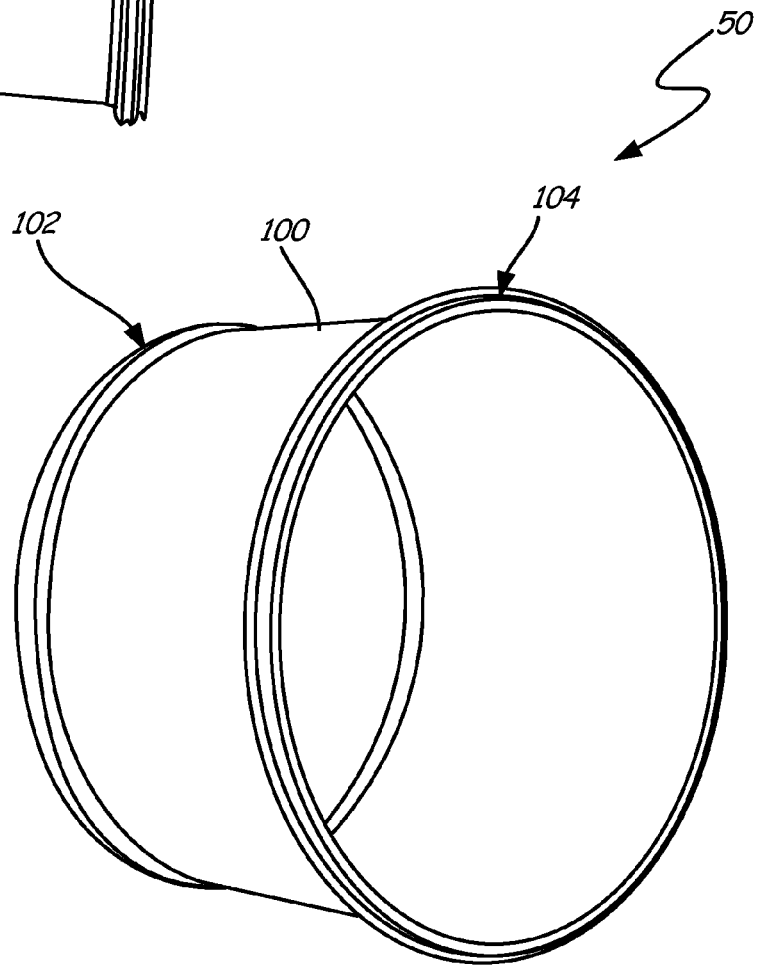

FIGS. 2A and 2B are perspective views of an embodiment of a diffuser incorporating the present invention. As shown in FIGS. 2A and 2B, diffuser 50 includes center perforated cone 100, inlet ring seal 102, and outlet ring seal 104. Perforated cone 100 has a frustoconical shape symmetrical about an axis of diffuser 50. Inlet ring seal 102 is attached to a first end of perforated cone 100 for connecting diffuser 50 to fan housing 12, as shown in FIG. 1. Outlet ring seal 104 is attached to a second end of perforated cone 100, opposite inlet ring seal 102, for connecting diffuser 50 to outer housing 18, as shown in FIG. 1. The second end of perforated cone 100 has a greater diameter than the first end of perforated cone 100. Perforated cone 100 is made of metal, for example, titanium, with a plurality of small perforations. Inlet ring seal 102 and outlet ring seal 104 are made of any durable, lightweight material, for example, a fiber-reinforced polymer composite, such as a laminated structure of plain-weave carbon-fiber fabric held together by a durable resin.

As noted above in reference to FIG. 1, in operation, the air flow from the rotation of fan rotor 42 moves into outer housing 18, flowing into a space defined by diffuser 50 and inner housing 20. Due largely to increasing volume provided by the frustoconical shape of perforate cone 100, air pressure and flow velocity of the air flow are both reduced, resulting in improved flow efficiency from the lower air pressure, and noise reduction from the lower flow velocity. In addition, interaction between the air flow and perforated cone 100 also results in noise abatement as described below.

Figure 3:
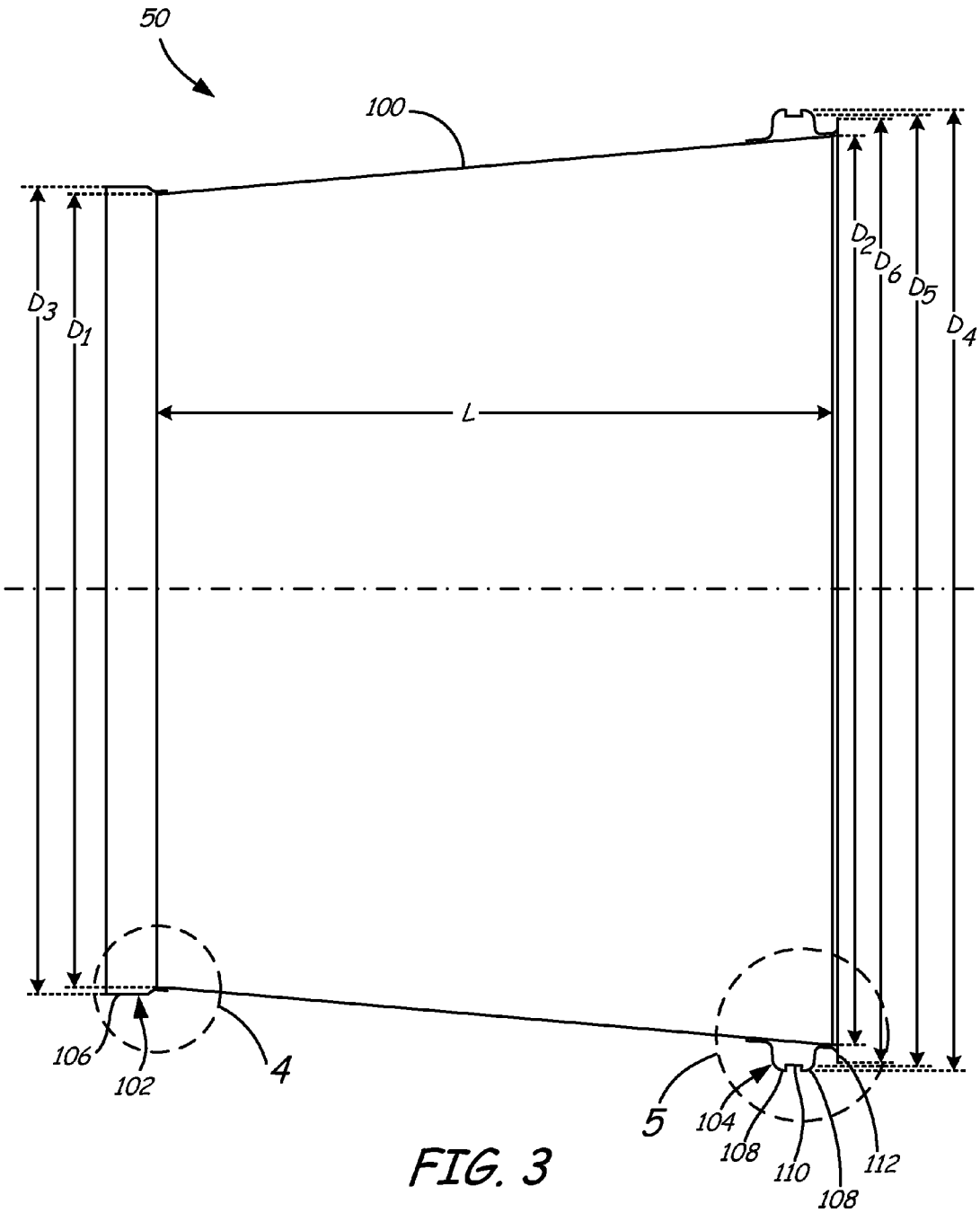
FIG. 3 is a cross-sectional view of the diffuser of FIGS. 2A and 2B.
Figure 4:
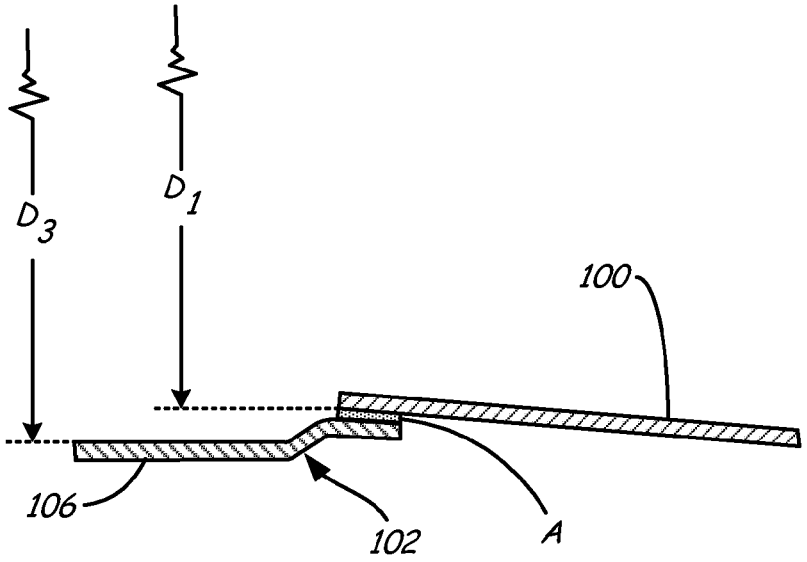
FIG. 4 is a close-up view of a portion of the cross-sectional view of the diffuser of FIG. 3.
Figure 5:
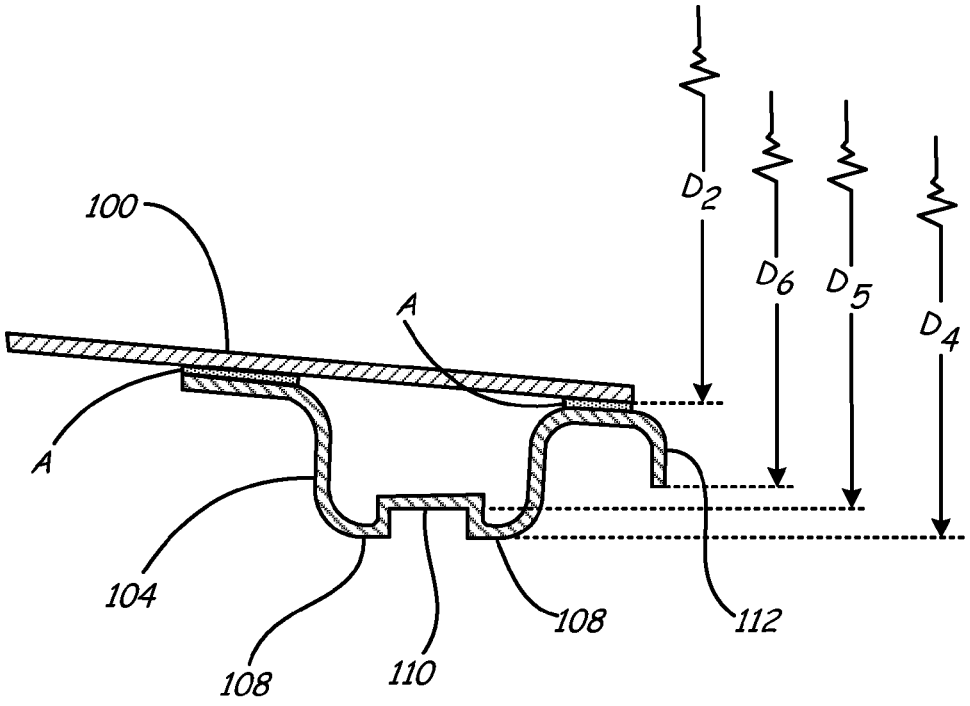
FIG. 5 is a close-up view of another portion of the cross-sectional view of the diffuser of FIG. 3.

FIG. 3 is a cross-sectional view of diffuser 50 of FIGS. 2A and 2B. FIGS. 4 and 5 are close-up views of different portions of the cross-sectional view of the diffuser of FIG. 3. FIG. 4 shows the connection between perforated cone 100 and inlet ring seal 102. FIG. 5 shows the connection between perforated cone 100 and outlet ring seal 104. Considering FIGS. 3, 4, and 5 together shows that inlet ring seal 102 and outlet ring seal 104 are attached to an external surface of perforated cone 100 to form diffuser 50. The attachments between perforated cone 100 and inlet ring seal 102 and between perforated cone 100 and outlet ring seal 104 are secured by a permanent adhesive (A). FIG. 4 also shows that inlet ring seal 102 includes fan housing connection 106. Fan housing connection 106 has a cylindrical shape, symmetrical about the axis of diffuser 50. A portion of inlet ring seal 102, including fan housing connection 106, extends beyond the first end of perforated cone 100. FIG. 5 also shows that outlet ring seal includes exterior surface 108, o-ring channel 110, and diffuser rim 112. Exterior surface 108 is a cylindrical surface broken by o-ring channel 110. Diffuser rim 112 extends beyond the second end of perforated cone 100 and radially outward in a plane perpendicular to the axis of diffuser 50. Exterior surface 108, o-ring channel 110, and diffuser rim 112 are also symmetrical about the axis of diffuser 50.

As shown in FIG. 1, diffuser 50 is accessible from the fan outlet end of ram air fan assembly 10, which greatly simplifies replacement of diffuser 50, beginning with removal of ram air fan assembly 10 from the aircraft. Ram air fan assembly 10 is a line-replaceable unit (LRU). LRUs are designed to be installed and removed easily and efficiently such that a new unit can replace a unit in need of repair or inspection quickly, getting the aircraft back into service while the LRU removed is taken elsewhere for repair or inspection. Considering FIGS. 1, 2A, 2B and 3 together, removal of diffuser 50 from ram air fan assembly 10 begins by disconnecting motor bearing cooling tube 52 from inner housing 20. Next, electrical wires are disconnected from terminal box 46 and pulled into inner housing 20. Wire transfer tube 54 is then disconnected from inner housing 20. Next, check valve 56 is removed from ram air fan assembly 10, and then diffuser 50 is pulled away from fan housing 12 and removed through the fan outlet end of ram air fan assembly 10. Installing diffuser 50 begins with orienting diffuser 50 such that fan housing connection 106 of inlet ring seal 102 faces the fan outlet before inserting diffuser 50 into the fan outlet end of ram air fan assembly 10. Diffuser 50 is inserted into the fan outlet such that diffuser 50 axially surrounds bearing housing 14 and at least a portion of each of fan housing 12 and inner housing 20. Next, diffuser 50 is pressed toward fan housing 12 such that fan housing connection 106 connects to fan housing 12 and outlet ring seal 104 connects to outer housing 18. Check valve 56 is inserted into the bypass inlet of ram air fan assembly 10. Next, wire transfer tube 54 is connected to inner housing 20, and then the electrical wires are feed through wire transfer tube 54 to terminal box 46, where the electrical wires are connected to terminal box 46. Motor bearing cooling tube 52 is connected to inner housing 20 to complete the installation of diffuser 50 into ram air fan assembly 10. The final step is installing ram air fan assembly 10 with newly installed replacement diffuser 50 back into the aircraft.

Figure 6A:
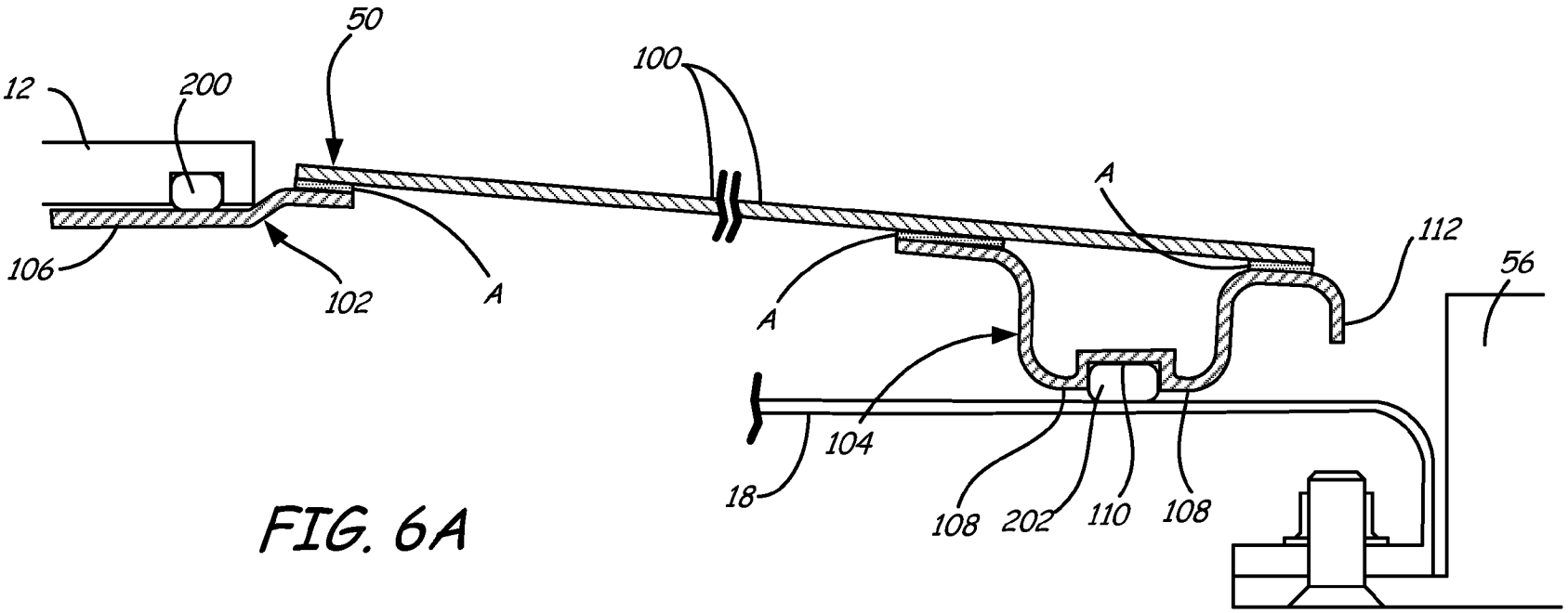
FIGS. 6A and 6B are close-up views of portions of the ram air fan assembly of FIG. 1.
Figure 6B:
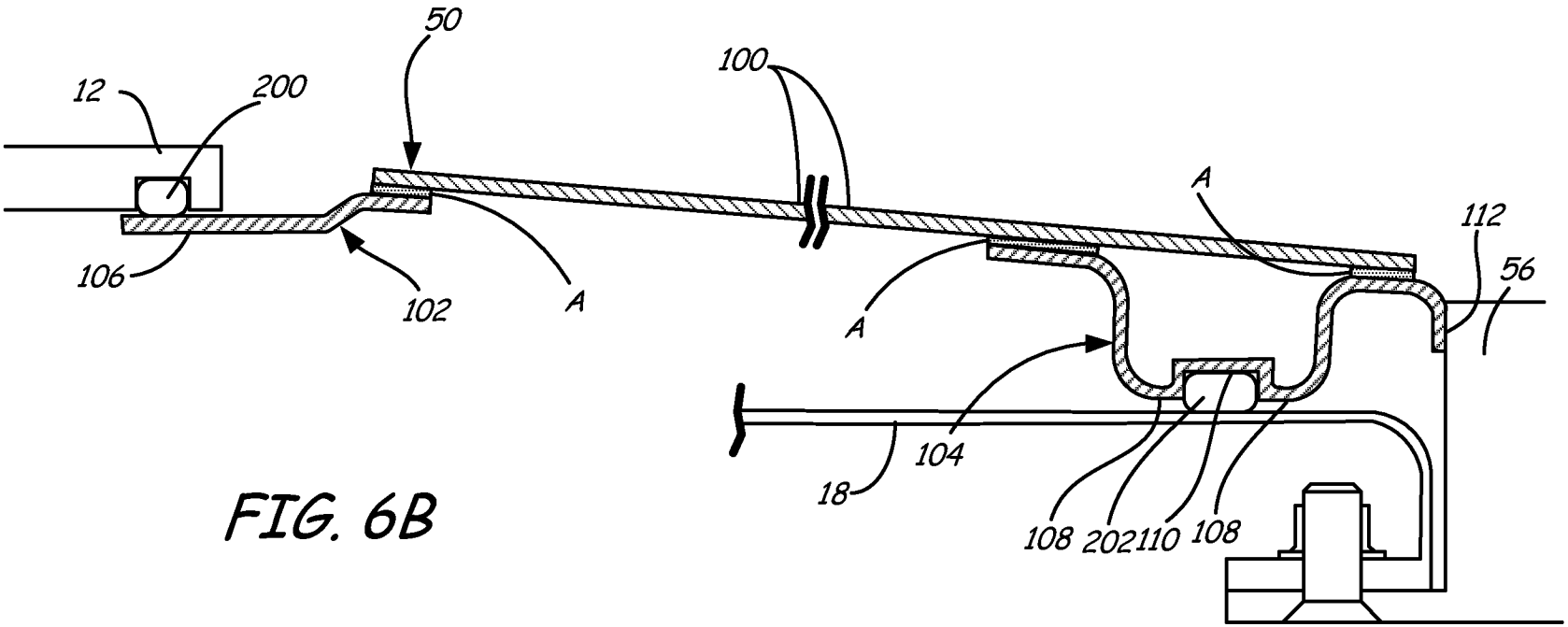

FIG. 6A is a close-up view portions of ram air fan assembly 10 of FIG. 1 illustrating more clearly the sealing details at each ring seal in ram air fan assembly 10. In FIG. 6A, diffuser 50 is pressed all the way toward fan housing 12, such as when diffuser 50 is initially installed in ram air fan assembly 10. As shown, at inlet ring seal 102, fan housing connection 106 seals against o-ring 200 partially contained in an o-ring channel in fan housing 12. Meanwhile, o-ring 202 partially contained in o-ring channel 110 of outlet ring seal 104 seals diffuser 50 against the surface of outer housing 18. Once in operation for some time, diffuser 50 may move away from fan housing 12 due to vibration and the flow of air past the surface of perforated cone 100. This is illustrated in FIG. 6B. FIG. 6B shows the same close-up view portions of ram air fan assembly 10 of FIG. 1 as FIG. 6A after diffuser 50 moves away from fan housing 12. Check valve 56 limits the movement of diffuser 50 away from fan housing 12 by physically contacting diffuser rim 112. Thus, diffuser 50 is held in position such that the seals formed by fan housing connection 106 and outlet ring seal 104 are maintained.

As shown in FIG. 1, the relative shapes and positioning of diffuser 50 and outer housing 18 creates a volume between diffuser 50 and outer housing 18. As noted above in reference to the embodiment of ram air fan assembly 10 of FIG. 1, this volume contains a noise abatement structure in the form of acoustic foam 62. Acoustic foam 62 is any of the acoustic foams known in the art for damping acoustical vibrations. In combination with perforations of perforated cone 100, acoustic foam 62 damps acoustical vibrations in the air flowing past diffuser 50.

In embodiments of the present invention, diffuser 50 directs air flow from fan rotor 42 through ram air fan assembly 10 and, by creating an increasing cross-sectional area into which the air flow from fan rotor 42 can diffuse, reduces air pressure and flow velocity of the air flow resulting in improved flow efficiency from the lower air pressure, and noise reduction from the lower flow velocity and greater length for damping acoustical vibrations. In one embodiment, perforated cone 100 extends away from inlet ring seal 102 and radially outward from the axis of diffuser 50 at an angle of about 5 degrees from the axis of diffuser 50. In another embodiment, perforated cone 100 extends away from inlet ring seal 102 and radially outward from the axis of diffuser 50 at an angle between 4.95 degrees and 5.11 degrees from the axis of diffuser 50.

In other embodiments, diffuser 50 is characterized by a length of perforated cone 100, a diameter of the first end of perforated cone 100, and a diameter of the second end of perforated cone 100. The length (L) of perforated cone 100 is a length of perforated cone 100 in a direction parallel to the axis of diffuser 50, as shown in FIG. 3. The diameter of the first end of perforated cone 100 (D1) is an average external diameter at the limit of the first end of perforated cone 100, as illustrated in FIGS. 3 and 4. The diameter of the second end of perforated cone 100 (D2) is an average external diameter at the limit of the second end of perforated cone 100, as illustrated in FIGS. 3 and 5. So defined, an embodiment of the present invention has a L of about 11.730 inches (or about 287.94 mm), a D1 of about 13.750 inches (or about 349.25 mm), and a D2 of about 15.815 inches (or about 401.70 mm). Another embodiment of the present invention has a L of between 11.720 inches and 11.740 inches (or between 297.69 mm and 298.20 mm), a D1 of between 13.735 inches and 13.765 inches (or between 348.87 mm and 349.63 mm), and a D2 of between 15.800 inches and 15.830 inches (or between 401.32 mm and 402.08 mm).

In yet other embodiments, diffuser 50 is characterized by a ratio of L to D2. In one embodiment of the present invention, the ratio of L to D2 is about 0.74. In another embodiment, the ratio of L to D2 is no less than 0.740 and no greater than 0.743. This feature ensures that, with D1 determined by a need to fit diffuser 50 to fan housing 12, diffuser 50 extends far enough along the path of air flow from fan housing 12 to control the diffusion of the air flow and provide a sufficient length over which perforated cone 100 and acoustic foam 62 can damp acoustical vibrations.

In any of the embodiments, diffuser 50 may be further characterized by a diameter of fan housing connection 106. The diameter of fan housing connection 106 (D3) is an internal diameter, as illustrated in FIGS. 3 and 4. So defined, some embodiments of the present invention have a D3 of about 13.950 inches (or about 354.33 mm). Other embodiments of the present invention have a D3 of between 13.935 inches and 13.965 inches (or between 353.95 mm and 354.71 mm).

In any of the embodiments, diffuser 50 may be further characterized by a diameter of exterior surface 108, a diameter of o-ring channel 110, and a diameter of diffuser rim 112. As illustrated in FIGS. 3 and 5, the diameter of exterior surface 108 (D4) is an average external diameter, the diameter of o-ring channel 110 (D5) is also an average external diameter, and the diameter of diffuser rim 112 (D6) is an average diameter at the limit of its radial extension. So defined, some embodiments of the present invention have a D4 of about 16.665 inches (or about 423.29 mm), a D5 of about 16.456 inches (or about 417.98 mm), and a D6 of about 16.445 inches (or about 417.70 mm). In other embodiments, D4 is between 16.650 inches and 16.680 inches (or between 422.91 mm and 423.67 mm) with a maximum external diameter of 16.695 inches (or 424.05 mm); D5 is between 16.441 inches and 16.471 inches (or between 417.60 mm and 418.36 mm) with a maximum external diameter of 16.486 inches (or 418.74 mm); and D6 is between 16.430 inches and 16.460 inches (or between 417.32 mm and 418.08 mm) with a maximum external diameter of 16.475 inches (or 418.47 mm).

A diffuser for a ram air fan assembly that embodies the present invention has a frustoconical perforated cone symmetrical about an axis of the diffuser. The shape of the perforated cone is determined by a specific range of angles with respect to an axis of the diffuser, or a specific ratio of length to diameter of the perforated cone. The shape and size of the perforated cone is determined by a specific range of the length of the perforate cone and specific ranges for diameters at either end. The perforated cone directs a flow of air from a fan rotor within the ram air fan assembly to diffuse the flow and enhance flow efficiency. In addition, the perforations of the perforated cone, in conjunction with acoustic foam, provide for damping of acoustical vibrations.

Novel aspects of diffuser 50, including the angle of perforated cone 100, of the present invention described herein are achieved by substantial conformance to specified geometries. It is understood that edge breaks and curved radii not specifically described herein, but normally employed in the art, may be added to diffuser 50 to enhance manufacturability, ease assembly, or improve durability while retaining substantial conformance to specified geometries.

Alternatively, substantial conformance is based on a determination by a national or international regulatory body, for example in a part certification or parts manufacture approval (PMA) process for the Federal Aviation Administration, the European Aviation Safety Agency, the Civil Aviation Administration of China, the Japan Civil Aviation Bureau, or the Russian Federal Agency for Air Transport. In these embodiments, substantial conformance encompasses a determination that a particular ram air fan diffuser is identical to, or sufficiently similar to, the specified diffuser 50, or that the ram air fan diffuser is sufficiently the same with respect to a part design in a type-certified ram air fan diffuser, such that the ram air fan diffuser complies with airworthiness standards applicable to the specified ram air fan diffuser. In particular, substantial conformance encompasses any regulatory determination that a particular part or structure is sufficiently similar to, identical to, or the same as a specified diffuser 50 of the present invention, such that certification or authorization for use is based at least in part on the determination of similarity.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A ram air fan diffuser for a ram air fan assembly, the diffuser comprising:

a perforated cone having a frustoconical shape symmetrical about an axis of the diffuser with a plurality of perforations between a first end and a second end of the perforated cone;

an inlet ring seal attached to and axially disposed about the first end of the perforated cone; and an outlet ring seal attached to and axially disposed about the second end of the perforated cone, wherein the outlet ring seal comprises a cylindrical exterior surface symmetrical about the axis of the diffuser, an o-ring channel within the cylindrical exterior surface, and a diffuser rim extending radially beyond the second end of the perforated cone and radially outward in a plane perpendicular from the axis of the diffuser;

wherein an average external diameter of the second end of the perforated cone is greater than an average external diameter of the first end of the perforated cone such that the perforated cone extends away from the inlet ring seal and radially outward from the axis of the diffuser.

2. The diffuser of claim 1, wherein the perforated cone extends away from the inlet ring seal and radially outward from the axis of the diffuser at an angle of between 4.95 degrees and 5.11 degrees from the axis of the diffuser.

3. The diffuser of claim 1, wherein the inlet ring seal and the outlet ring seal are made of fiber-reinforced polymer composite and the perforated cone is made of metal.

4. The diffuser of claim 1, wherein a ratio of a length of the perforated cone to the average external diameter of the second end of the perforated cone is about 0.74, wherein the length of the perforated cone is a distance in a direction parallel to the axis of the diffuser.

5. The diffuser of claim 1, wherein a ratio of a length of the perforated cone to the average external diameter of the second end of the perforated cone is no less than 0.740 and no greater than 0.743, wherein the length of the perforated cone is a distance in a direction parallel to the axis of the diffuser.

6. The diffuser of claim 1, wherein a length of the perforated cone is about 11.730 inches (or about 297.94 mm), the average external diameter of the first end of the perforated cone is about 13.750 inches (or about 349.25 mm), and the average external diameter of the second end of the perforated cone is about 15.815 inches (or about 401.70 mm).

7. The diffuser of claim 1, wherein a length of the perforated cone is between 11.720 inches and 11.740 inches (or between 297.69 mm and 298.20 mm), the average external diameter of the first end of the perforated cone is between 13.735 inches and 13.765 inches (or between 348.87 mm and 349.63 mm), and the average external diameter of the second end of the perforated cone is between 15.800 inches and 15.830 inches (or between 401.32 mm and 402.08 mm).

8. The diffuser of claim 1, wherein the inlet ring seal comprises a fan housing connection having a cylindrical shape; and an internal diameter of the fan housing connection is about 13.950 inches (or about 354.33 mm).

9. The diffuser of claim 1, wherein the inlet ring seal comprises a fan housing connection having a cylindrical shape; and an internal diameter of the fan housing connection is between 13.935 inches and 13.965 inches (or between 353.95 mm and 354.71 mm).

10. The diffuser of claim 1, wherein an average external diameter of the cylindrical exterior surface is about 16.665 inches (or about 423.29 mm); an average external diameter of the o-ring channel is about 16.456 inches (or about 417.98 mm); and an average diameter of the diffuser rim at an outermost radial limit of a radial extension of the diffuser rim is about 16.445 inches (or about 417.70 mm).

11. The diffuser of claim 1, wherein an average external diameter of the cylindrical exterior surface is between 16.650 inches and 16.680 inches (or between 422.91 mm and 423.67 mm) with a maximum external diameter of 16.695 inches (or 424.05 mm); an average external diameter of the o-ring channel is between 16.441 inches and 16.471 inches (or between 417.60 mm and 418.36 mm) with a maximum external diameter of 16.486 inches (or 418.74 mm); and an average diameter of the diffuser rim at an outermost radial limit of a radial extension of the diffuser rim is between 16.430 inches and 16.460 inches (or between 417.32 mm and 418.08 mm) with a maximum external diameter of 16.475 inches (or 418.47 mm).

12. A ram air fan assembly comprising:

a fan housing;

a fan rotor;

a bearing housing attached to the fan housing;

an outer housing connected to the fan housing;

an inner housing attached to the bearing housing; and a diffuser disposed axially within the outer housing and disposed axially about the bearing housing and at least a portion of each of the fan housing and the inner housing for diffusing fan air from the fan rotor, the diffuser comprising:

a perforated cone having a frustoconical shape symmetrical about an axis of the diffuser with a plurality of perforations between a first end and a second end of the perforated cone;

an inlet ring seal attached to and axially disposed about the first end of the perforated cone; the inlet ring seal comprising a fan housing connection having a cylindrical shape; and an outlet ring seal for connecting the diffuser to the outer housing; the outlet ring seal attached to and axially disposed about the second end of the perforated cone, wherein the outlet ring seal comprises a cylindrical exterior surface symmetrical about the axis of the diffuser, an o-ring channel within the cylindrical exterior surface, and a diffuser rim extending radially beyond the second end of the perforated cone and radially outward in a plane perpendicular from the axis of the diffuser;

wherein an average external diameter of the second end of the perforated cone is greater than an average external diameter of the first end of the perforated cone such that the perforated cone extends away from the inlet ring seal and radially outward from the axis of the diffuser.

13. The ram air fan assembly of claim 12, wherein the perforated cone extends away from the inlet ring seal and radially outward from the axis of the diffuser at an angle of between 4.95 degrees and 5.11 degrees from the axis of the diffuser.

14. The ram air fan assembly of claim 12, wherein the perforated cone extends away from the inlet ring seal and radially outward from the axis of the diffuser at an angle of about 5 degrees from the axis of the diffuser.

15. The ram air fan assembly of claim 12, wherein the inlet ring seal and the outlet ring seal are made of fiber-reinforced polymer composite and the perforated cone is made of metal.

16. The ram air fan assembly of claim 12, wherein a ratio of a length of the perforated cone to the average external diameter of the second end of the perforated cone is no less than 0.740 and no greater than 0.743, wherein the length of the perforated cone is a distance in a direction parallel to the axis of the diffuser.

17. The ram air fan assembly of claim 12, wherein a length of the perforated cone is between 11.720 inches and 11.740 inches (or between 297.69 mm and 298.20 mm), the average external diameter of the first end of the perforated cone is between 13.735 inches and 13.765 inches (or between 348.87 mm and 349.63 mm), and the average external diameter of the second end of the perforated cone is between 15.800 inches and 15.830 inches (or between 401.32 mm and 402.08 mm).

18. The ram air fain assembly of claim 12 further comprising:

acoustic foam occupying at least most of a volume between the perforated cone and the outer housing.

19. A method for installing a ram air fan diffuser in a ram air fan assembly, the diffuser comprising a perforated cone having a frustoconical shape symmetrical about an axis of the diffuser with a plurality of perforations between a first end and a second end of the perforated cone; an inlet ring seal attached to and axially disposed about the first end of the perforated cone having a fan housing connection; and an outlet ring seal attached to and axially disposed about the second end of the perforated cone, wherein the outlet ring seal comprises a cylindrical exterior surface symmetrical about the axis of the diffuser, an o-ring channel within the cylindrical exterior surface, and a diffuser rim extending radially beyond the second end of the perforated cone and radially outward in a plane perpendicular from the axis of the diffuser; wherein an average external diameter of the second end of the perforated cone is greater than an average external diameter of the first end of the perforated cone such that the perforated cone extends away from the inlet ring seal and radially outward from the axis of the diffuser, the method comprising:

orienting the diffuser such that the fan housing connection of the inlet ring seal faces a fan outlet of the ram air fan assembly;

inserting the diffuser into the fan outlet such that the diffuser axially surrounds a bearing housing and at least a portion of each of a fan housing and an inner housing;

pressing the diffuser toward the fan housing such that the fan housing connection of the inlet ring seal connects to the fan housing and the outlet ring seal connects to an outer housing;

inserting a check valve into a bypass inlet of the ram air fan assembly;

connecting a wire transfer tube to the inner housing;

feeding electrical wires from the inner housing, through the wire transfer tube, to a terminal box;

connecting the electrical wires to the terminal box; and connecting a motor bearing cooling tube to the inner housing.

* * * * *